US009037046B2

(12) United States Patent
Bachar et al.

(10) Patent No.: US 9,037,046 B2
(45) Date of Patent: May 19, 2015

(54) LIQUID ELECTROPHOTOGRAPHY PRINTING APPARATUS AND METHODS THEREOF

(75) Inventors: Eyal Bachar, Modi'in (IL); Kobi Shkuri, Rehovot (IL); Elliad Silcoff, Tel Aviv (IL); Yoram Sorek, Yahud (IL); Yossi Cohen, Rehovot (IL); Nava Klein, Rishon le Tzion (IL); Doron Schlumm, Kfar Harif (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 56 days.

(21) Appl. No.: 13/978,922

(22) PCT Filed: Jan. 21, 2011

(86) PCT No.: PCT/EP2011/050815
§ 371 (c)(1),
(2), (4) Date: Nov. 26, 2013

(87) PCT Pub. No.: WO2012/097877
PCT Pub. Date: Jul. 26, 2012

(65) Prior Publication Data

US 2014/0105648 A1 Apr. 17, 2014

(51) Int. Cl.
*G03G 15/10* (2006.01)
*G03G 21/00* (2006.01)

(52) U.S. Cl.
CPC ..... *G03G 15/10* (2013.01); *G03G 15/104* (2013.01); *G03G 21/0094* (2013.01); *G03G 2215/0626* (2013.01)

(58) Field of Classification Search
CPC ..... G03G 15/104; G03G 2215/0626; G03G 21/0094
USPC ..... 399/237
See application file for complete search history.

(56) References Cited

U.S. PATENT DOCUMENTS

| | | | | |
|---|---|---|---|---|
| 3,991,709 | A | 11/1976 | Sato | |
| 4,640,605 | A * | 2/1987 | Ariyama et al. | 399/225 |
| 6,011,943 | A * | 1/2000 | Kim | 399/238 |
| 6,613,491 | B2 | 9/2003 | Inoue et al. | |
| 6,878,498 | B2 | 4/2005 | Yoshino et al. | |
| 7,435,520 | B2 | 10/2008 | Bae | |
| 2003/0170057 | A1 * | 9/2003 | Berg et al. | 399/348 |
| 2009/0220884 | A1 | 9/2009 | Almog et al. | |
| 2009/0311614 | A1 | 12/2009 | Almog et al. | |
| 2010/0111577 | A1 * | 5/2010 | Soria et al. | 399/302 |
| 2010/0150608 | A1 * | 6/2010 | Mitsumori et al. | 399/159 |

FOREIGN PATENT DOCUMENTS

| | | |
|---|---|---|
| GB | 1244901 | 9/1971 |
| WO | WO-01/92968 | 10/2001 |

OTHER PUBLICATIONS

International Search Report and Written Opinion received in PCT Application No. PCT/EP2011/050815, mailed Oct. 18, 2011, pp. 10.

* cited by examiner

*Primary Examiner* — David Gray
*Assistant Examiner* — Thomas Giampaolo, II

(57) ABSTRACT

A method of maintaining a photoconductive member of a liquid electrophotography printing apparatus (LEP) is disclosed. The method includes storing a fluid having at least fluid particles and a carrier liquid in a fluid chamber and removing at least a portion of the fluid particles and the dissolved materials from the fluid through adsorption by filtration material disposed within a filtration assembly to form a filtered fluid. The method also includes maintaining the photoconductive member by periodically applying the filtered fluid to the photoconductive member and removing the filtered fluid and fluid residue therefrom.

13 Claims, 5 Drawing Sheets

LIQUID ELECTROPHOTOGRAPHY PRINTING APPARATUS AND METHODS THEREOF

BACKGROUND

Liquid electrophotography printing apparatus includes providing fluid such as liquid toner to fluid applicators such as binary ink developers. The fluid applicators provide charged liquid toner to a latent image on a photoconductive member to form fluid images. The photoconductive member transfers the fluid images onto an image transfer member and/or substrate. Generally, the liquid toner includes charge directors to electrically charge the liquid toner.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
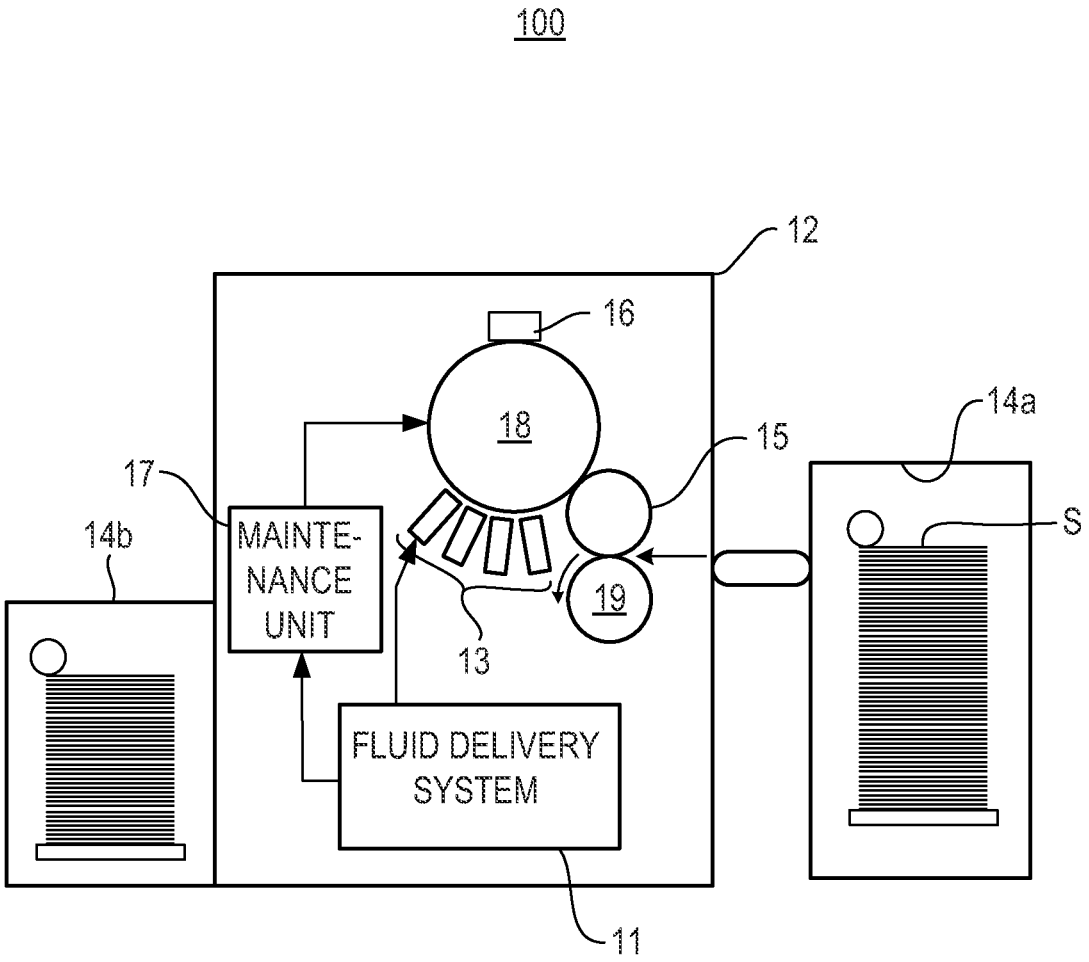
FIG. 1 is a schematic view illustrating a liquid electrophotography printing apparatus according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Liquid electrophotography printing apparatus (LEP) provides fluid such as liquid toner including charge directors, dissolved materials, and carrier fluid to fluid applicators such as binary ink developers (BIDs). A fluid chamber receives the charge directors, dissolved materials, and carrier fluid forming the liquid toner. The liquid toner is charged and is provided to a latent image on a photoconductive member such as a photo imaging member (PIP) to form a fluid image, for example, by BIDs. The photoconductive member, in turn, provides the image to an image transfer member such as an image transfer blanket. The image transfer blanket transfers the image onto a substrate such as print media. Degradation of the photoconductive member and image quality may occur over time, however, based on an accumulation of fluid particles and/or dissolved materials in the fluid such as charge directors, contaminants and fluid residue. That is, such accumulation may scratch and/or undesirably remain on the photoconductive member, increase old pip stickiness syndrome (OPS) due to an overabundance of charge directors, and negatively contribute to printing side effects such as electrical fatigue, or the like.

In examples of the present disclosure, a LEP includes a filtration assembly configured to store filtration material to remove fluid particles and dissolved materials from a fluid from the fluid chamber to form a filtered fluid. For example, such fluid particles and dissolved materials may be removed by adsorption to remove charge directors and contaminants therein which may have otherwise passed through a mesh screen while reducing its impedance on desirable soluble components of the respective fluid. The LEP also includes a maintenance unit configured to periodically apply the filtered fluid from the filtration assembly to the photoconductive member and to remove at least the filtered fluid from the photoconductive member. Such maintenance of the photoconductive member and use of the filtered fluid thereon, increases the lifespan of the photoconductive member and extends the period of time in which high-quality images are produced.

In an example, the LEP also includes a detector assembly configured to detect at least one fluid parameter of the fluid and a filtration adder unit configured to automatically add a predetermined amount of the filtration material to the filtration assembly based on the detection of the at least one fluid parameter. The automatic addition of the predetermined amount of the filtration material based on the at least one fluid parameter enables effective removal of the unwanted fluid particles and dissolved materials from the fluid to form filtered fluid to be used to maintain the photoconductive member. That is, an appropriate amount of the filtration material inserted in small doses during operation of the LEP effectively increases the adsorption of the filtration assembly. Accordingly, degradation of the photoconductive member and image quality is reduced.

FIG. 1 is a schematic view illustrating a liquid electrophotography printing apparatus according to an example. Referring to FIG. 1, a liquid electrophotography printing apparatus (LEP) 100 includes an image forming unit 12 that receives a substrate S such as a print media from an input unit 14*a* and outputs the substrate S to an output unit 14*b*. The image forming unit 12 includes a photoconductive member 18 on which images can be formed. The photoconductive member 18 may be charged with a suitable charger (not illustrated) such as a charge roller. Portions of the outer surface of the photoconductive member 18 that correspond to features of the image can be selectively discharged by a laser writing unit 16 to form an electrostatic and/or latent image thereon.

Referring to FIG. 1, the LEP 100 also includes a fluid delivery system 11 to supply fluid such as liquid toner, for example, ElectroInk, trademarked by Hewlett-Packard Company, to fluid applicators such as BIDs 13 and fluid to a maintenance unit 17 to be used to maintain the photoconductive member 18. The BIDs 13 apply the fluid to the electrostatic and/or latent image to form a fluid image on the photoconductive member 18 to be transferred to an intermediate transfer member (ITM) 15. The ITM 15 is configured to receive the fluid image from the photoconductive member 18, heat the fluid image, and transfer the fluid image to the substrate S. During the transfer from the ITM 15 to the substrate 5, the substrate S is pinched between the ITM 15 and an impression member 19. Once the fluid image has been transferred to the substrate S, the substrate S can be transported to the output unit 14*b*.

Figure 2:
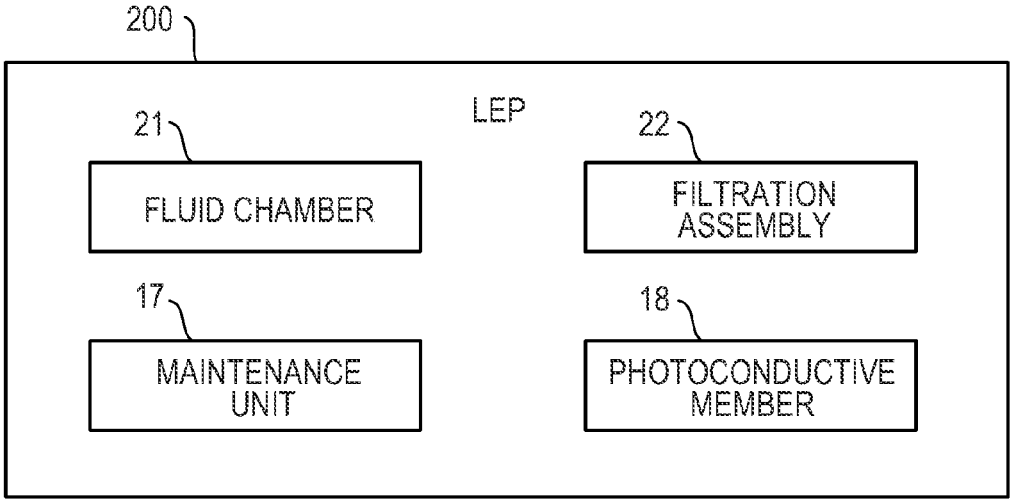
FIG. 2 is a block diagram illustrating a liquid electrophotography printing apparatus according to an example.

FIG. 2 is a block diagram illustrating a liquid electrophotography printing apparatus according to an example. Referring to FIG. 2, in the present example, the LEP 200 includes a fluid chamber 21, a filtration assembly 22, a maintenance unit 17, and a photoconductive member 18. The photoconductive member 18 includes a surface configured to form a latent image thereon. The fluid chamber 21 is configured to store fluid having at least fluid particles, dissolved materials and a carrier liquid to be provided to the latent image of the photoconductive member 18 to form a fluid image corresponding thereto. In examples, the fluid chamber 21 may be a reservoir, ink tank, or the like. The carrier liquid in the liquid toner may include imaging oil such as Isopar, trademarked by Exxon Corporation, having a charge director compound dispersed therein. In the present example, the fluid may be filtered to be used as a maintenance fluid on the photoconductive member 18. In another example, the filtered fluid may also be provided to an ink tank 59 (FIG. 5) to dilute printing fluid stored therein to be supplied to the latent image of the photoconductive member 18 and subsequently to a substrate S in the form of images.

As illustrated in FIG. 2, the filtration assembly 22 is in fluid communication with the fluid chamber 21. Further, the filtration assembly 22 is configured to store filtration material to remove at least a portion of fluid particles and dissolved materials from the fluid from the fluid chamber 21 to form a filtered fluid. In the present example, the fluid from the fluid chamber 21 is filtered outside of the fluid chamber 21. In other examples, the fluid from the fluid chamber 21 may be filtered therein. In an example, the filtration material may include sorption material such as silica gel, activated carbon, or the like, to remove at least a portion of the fluid particles and/or dissolved materials such as charge directors and contaminants by adsorption. In an example, at least one of the fluid particles and the dissolved materials may include charge directors, contaminants, and fluid residue. In examples, at least one of the fluid particles and the dissolved materials may include ink particles, charge directors, contaminants, and fluid residue. Fluid residue may include a portion of the fluid transferred to the latent image that remains on the photoconductive member 18 after the transfer of a fluid image from the photoconductive member 18 corresponding to the latent image.

Referring to FIG. 2, the maintenance unit 17 is configured to periodically apply the filtered fluid from the filtration assembly 22 to the photoconductive member 18 and to remove at least the filtered fluid from the photoconductive member 18. In an example, the maintenance unit 17 removes the filtered fluid and fluid residue from the photoconductive member 18. The maintenance unit 17 may be a cleaning and cooling unit. That is, the maintenance unit 17 may maintain the photoconductive member 18 by cleaning and cooling it through the periodic application of the filtered fluid thereto and removal of at least the filtered fluid therefrom.

Figure 3:
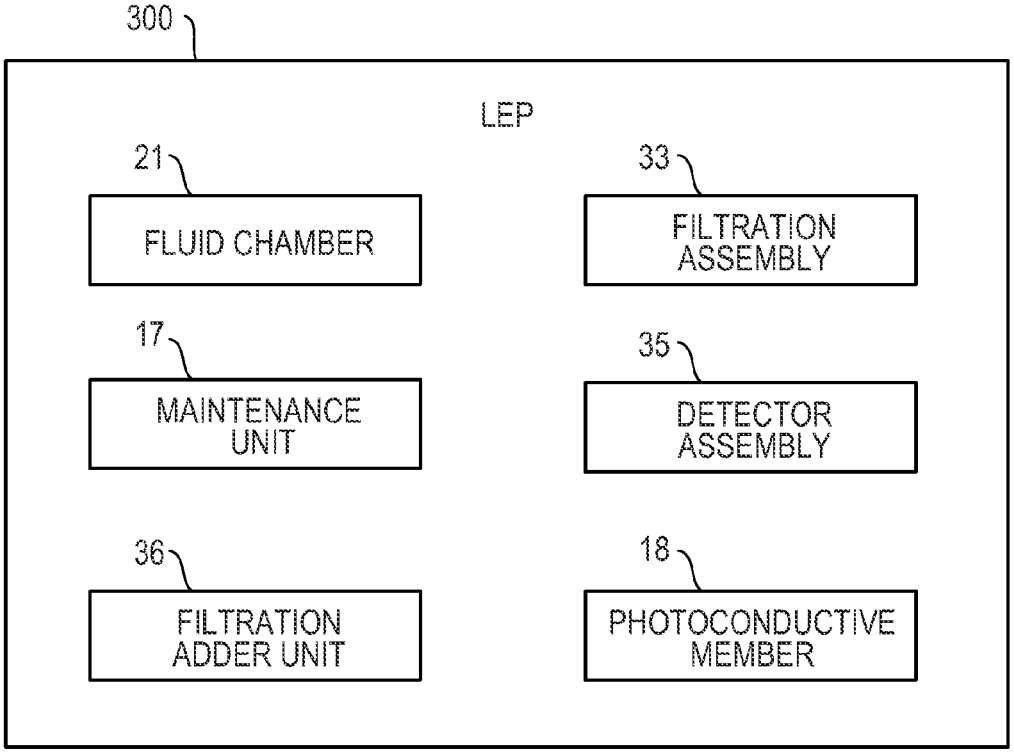
FIG. 3 is a block diagram illustrating a liquid electrophotography printing apparatus according to an example.

FIG. 3 is a block diagram illustrating a liquid electrophotography printing apparatus according to an example. Referring to FIG. 3, in the present example, a LEP 200 includes the fluid chamber 21, the maintenance unit 17, and the photoconductive member 18 as previously disclosed with respect to the LEP 200 illustrated in FIG. 2. In addition, in the present example, the LEP 300 as illustrated in FIG. 3 includes a filtration assembly 33 to automatically receive and store filtration material to remove at least a portion of fluid particles and dissolved materials by adsorption from the fluid from the fluid chamber 21 to form a filtered fluid. Referring to FIG. 3, the LEP 300 also includes a detector assembly 35 and a filtration adder unit 36. The detector assembly 35 is configured to detect at least one fluid parameter of the fluid. In an example, the fluid parameter may include at least one of a predetermined electrical conductivity value such as low field conductivity. The low field conductivity may correspond to a dissolved contaminant concentration and/or an amount of charge directors (e.g., charge level) in the respective fluid.

Referring to FIG. 3, the filtration adder unit 36 is configured to automatically add a predetermined amount of the filtration material to the filtration assembly 33 based on the detection of the at least one parameter. The amount of filtration material to be added to the filtration assembly 33 corresponds to the detected parameter. For example, for a respective fluid, a lookup table 56 (FIG. 5) may be accessed by the LEP 300 to indicate the respective predetermined amount of filtration material to be added for a corresponding parameter value. In an example, the at least one parameter may be a low field conductivity value of 5 picosiemens and a corresponding predetermined amount of filtration material may be a dose of silica gel paste having thirty-five-forty-five wt % in Isopar. In other examples, the silica gel may also be added in the form of a dry powder. Accordingly, in operation, small doses of the filtration material may be automatically inserted into the filtration assembly 33, for example, through an input port thereof to provide adsorption efficiency. Thus, an adjustable filtration material addition rate may be provided for different contamination rates.

Figure 4:
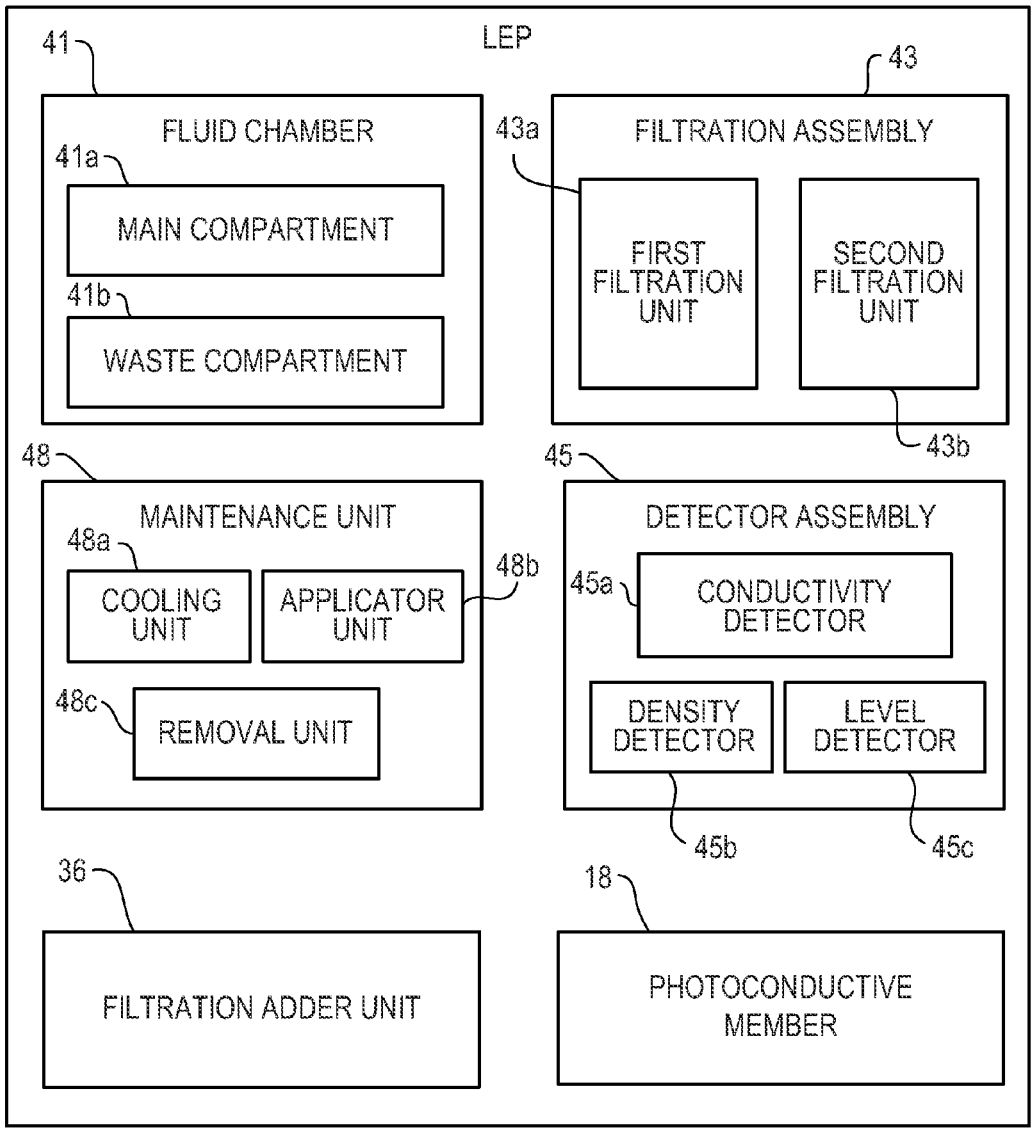
FIG. 4 is a block diagram of a liquid electrophotography printing apparatus according to an example.

FIG. 4 is a block diagram of a liquid electrophotography printing apparatus according to an example. Referring to FIG. 4, in the present example, the LEP 400 includes the filtration adder unit 36 and the photoconductive member 18 as previously disclosed with respect to the LEP 300 illustrated in FIG. 3. In addition, as illustrated in FIG. 4, the LEP 400 includes a fluid chamber 41, a filtration assembly 43, a detector assembly 45 and a maintenance unit 48. The fluid chamber 41 may include a main compartment 41*a* and a waste compartment 41*b*. The main compartment 41*a* is configured to store the filtered fluid. The waste compartment 41*b* is configured to store the fluid and the fluid residue removed from the photoconductive member 18.

Referring to FIG. 4, the filtration assembly 43 may include a first filtration unit 43*a* and a second filtration unit 43*b*. The first filtration unit 43*a* is in fluid communication with the main compartment 41*a* of the fluid chamber 41. The first filtration unit 43*a* may include silica gel to filter the fluid in the main compartment 41*a* to form a first-filtered fluid and to provide the first-filtered fluid to the main compartment 41*a*. In the present example, the silica gel of the first filtration unit 43*a* removes charge directors and dissolved materials from the fluid through adsorption. The second filtration unit 43*b* is in fluid communication with the waste compartment 41*b* and the main compartment 41*a* of the fluid chamber 41. The second filtration unit 43*b* may include a mesh screen to filter the fluid from the waste compartment 41*b* to form a second-filtered fluid and to provide the second-filtered fluid to the main compartment 41*a*. In the present example, the mesh screen of the second filtration unit 43*b* removes contaminants and fluid residue from the respective fluid.

Figure 5:
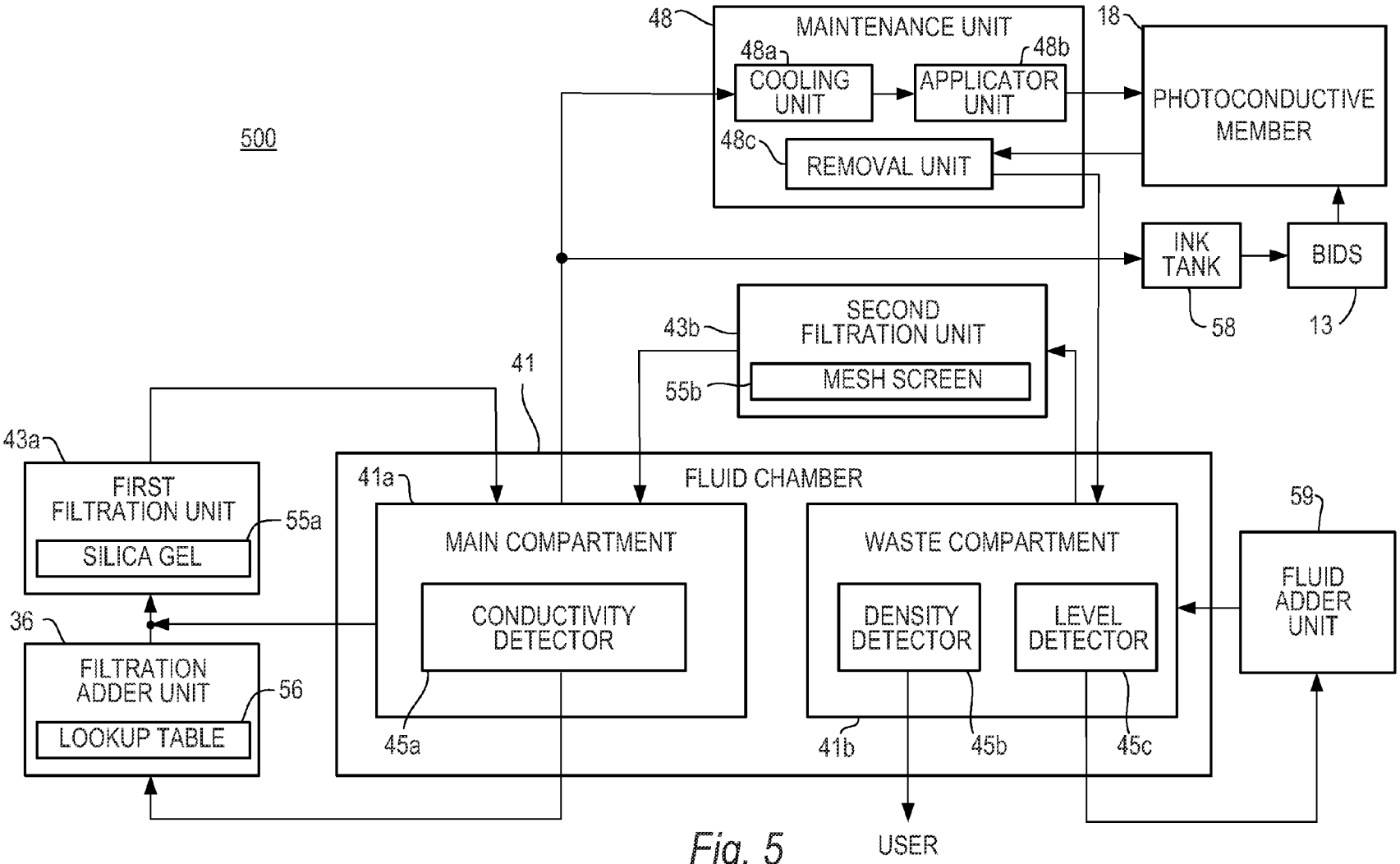
FIG. 5 is a schematic diagram of a liquid electrophotography printing apparatus according to an example.

Referring to FIG. 4, the detector assembly 45 may be configured to detect at least one fluid parameter of the fluid and include a conductivity detector 45*a* to detect low field conductivity as previously disclosed with respect to FIG. 3. Referring to FIG. 4, the detector assembly 45 may also include a density detector 45*b* and a level detector 45*c*. The density of fluid may correspond to a dirtiness level of the respective fluid. The level detector 45*c* may include a level switch that switches on when a predetermined level of the respective fluid is achieved. For example, as illustrated in FIG. 5, the density detector 45*b* detects and informs a user when a predetermined density value is achieved. The predetermined density value may correspond to a lower limit of an acceptable dirtiness level of the fluid. Accordingly, the user may be alerted to change the second filtration unit 43*b* prior to the dirtiness level of the fluid achieving an unacceptable level. The level detector 45*c* detects and communicates to a fluid adder unit 59 that a predetermined fluid level has been achieved in the waste compartment 41*b* causing the fluid adder unit 59 to add supplemental fluid such as carrier fluid to the waste compartment 41*b*.

Referring to FIG. 4, in the present example, the maintenance unit 48 includes a cooling unit 48*a*, an applicator unit 48*b*, and a removal unit 48*c*. The cooling unit 48*a* is configured to receive and cool the filtered fluid from the filtration assembly 43 to be applied to the photoconductive member 18. In an example, the cooling unit 48*a* provides the cooled filtered fluid, for example, received from the cooling unit 48*a*, to the applicator unit 48*b*. The cooling unit 48*a* may include a heat exchanger and/or a chamber having tubes transporting cold water, or the like, therethrough and in contact with the fluid to be cooled. The applicator unit 48*b* is configured to periodically apply the filtered fluid to the photoconductive member 18. The applicator unit 48*b* may include a pressure unit and a conduit to pressurize and direct fluid to be applied to the photoconductive member 18 therethrough. For example, the pressure unit may include a pump such as a piston-based apparatus and/or a pressure-assisted can, or the like.

Referring to FIG. 4, the removal unit 48*c* is configured to subsequently remove at least the filtered fluid from the photoconductive member 18. In an example, the removal unit 48*c* may also remove fluid residue from the photoconductive member 18. The removal unit 48*c* may include a wiper, a catch basin and/or a conduit. The wiper may wipe the filtered fluid and fluid residue from the photoconductive member 18. The catch basin may catch the filtered fluid and fluid residue removed from the photoconductive member 18. The conduit may transport the filtered fluid and fluid residue from the photoconductive member 18 to the waste compartment 41*b*.

FIG. 5 is a schematic diagram of a liquid electrophotography printing apparatus according to an example. Referring to FIG. 5, in the present example, the LEP 500 includes a fluid chamber 41, a detector assembly 45*a*, 45*b* and 45*c*, a filtration adder unit 36, a filtration assembly 43*a* and 43*b*, a maintenance unit 48, an ink tank 58, BIDs 13, a fluid adder unit 59, and a photoconductive member 18. The LEP 500 may also include pumps (not illustrated) to assist with fluid flow therein. The fluid chamber 41 includes a main compartment 41*a* and a waste compartment 41*b*. The detector assembly 45*a*, 45*b* and 45*c* includes a conductivity detector 45*a* to detect low field conductivity values of fluid, a density detector 45*b* to detect density of fluid, and a level detector 45*c* to detect a level of fluid as previously disclosed with respect to FIG. 4. The filtration adder unit 36 may access and/or include a lookup table 56. The filtration assembly 43*a* and 43*b* includes a first filtration unit 43*a* and a second filtration unit 43*b*. The maintenance unit 48 includes a cooling unit 48*a*, an applicator unit 48*b*, and a removal unit 48*c*.

Referring to FIG. 5, in operation, the ink tank 58 supplies printing fluid to the BIDs 13 to be provided to a respective latent image on the photoconductive member 18 to form a fluid image thereon. Subsequently, the printing fluid is supplied to a substrate S in the form of images. When necessary, filtered fluid from the main compartment 41*a* of the fluid chamber 41 is provided to the ink tank 58 to dilute the printing fluid. The filtered fluid from the main compartment 41*a* is also provided to the maintenance unit 48. That is, the cooling unit 48*a* cools the filtered fluid received from the main compartment 41*a* and provides the cooled filtered fluid to the applicator unit 48*b*. The applicator unit 48*b* periodically applies the cooled filtered fluid received from the cooling unit 48*a* to the photoconductive member 18. The removal unit 48*c* subsequently removes the filtered fluid and fluid residue from the photoconductive member 18 and provides it to the waste compartment 41*b*. Accordingly, the photoconductive member 18 is maintained through the cooling and cleaning of the photoconductive member 18 by the respective filtered fluid applied thereto.

As illustrated in FIG. 5, the waste compartment 41*b* stores the fluid and the fluid residue removed from the photoconductive member 18. The main compartment 41*a* stores filtered fluid filtered by the first filtration unit 43*a* and the second filtration unit 43*b*. The first filtration unit 43*a* forms a first-filtered fluid from the fluid from the main compartment 41*a* and provides the first-filtered fluid to the main compartment 41*a*. That is, silica gel in the first filtration unit 43*a* removes charge directors and dissolved materials from the fluid by adsorption. The filtration adder unit 36 periodically adds a predetermined amount of silica gel 55*a* to the first filtration unit 43*a* in response to a respective predetermined low field conductivity value of the fluid from the main compartment 41*a* detected and supplied by a conductivity detector 45*a* to the fluid adder unit 59. In an example, the low field conductivity of the fluid from the main compartment 41*a* is maintained above five picosiemens.

Referring to FIG. 5, the second filtration unit 43*b* forms a second-filtered fluid and provides the second-filtered fluid to the main compartment 41*a*. A second-filtered fluid is formed by a mesh screen 55*b* of the second filtration unit 43*b* removing fluid particles including contaminants and fluid residue from the fluid from the waste compartment 41*b*, for example, having a size greater than a size of the respective mesh openings of the mesh screen 55*b*. The level detector 45*c* detects and communicates to the fluid adder unit 59 that a predetermined fluid level has been achieved in the waste compartment 41*b*. In response to the predetermined fluid level being achieved, the fluid adder unit 59 adds supplemental fluid such as carrier fluid to the waste compartment 41*b*. The density detector 45*b* detects and informs a user when a predetermined density value is achieved. The predetermined density value may correspond to a lower limit of an acceptable dirtiness level of the fluid. Accordingly, the user may be alerted to change the second filtration unit 43*b* prior to the dirtiness level of the fluid achieving an unacceptable level.

Figure 6:
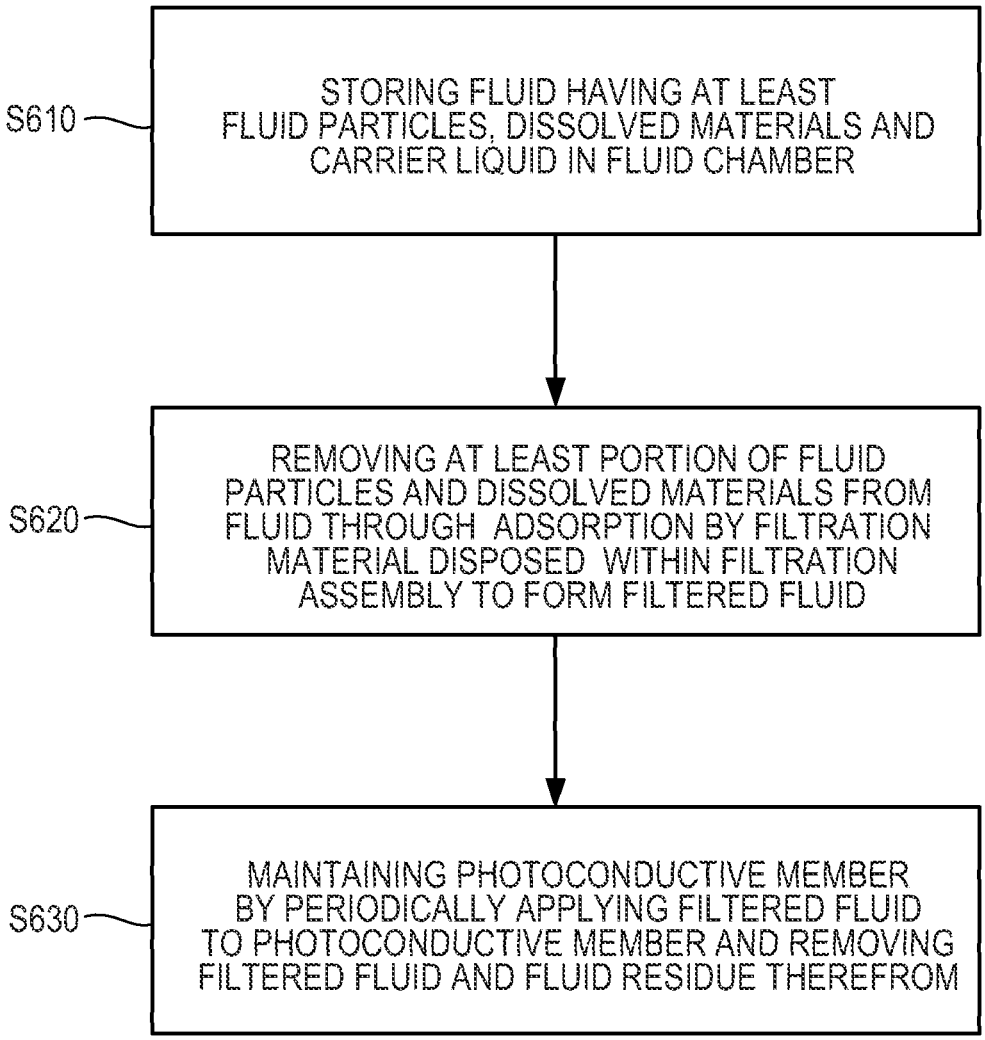
FIG. 6 is a flowchart illustrating a method of maintaining a photoconductive member of a liquid electrophotography printing apparatus according to an example.

FIG. 6 is a flowchart illustrating a method of maintaining a photoconductive member of a liquid electrophotography printing apparatus according to an example. Referring to FIG. 6, in block 3610, a fluid having at least fluid particles, dissolved materials and a carrier liquid is stored in a fluid chamber. In block S620, at least a portion of the fluid particles and the dissolved materials are removed from the fluid through adsorption by filtration material disposed within a filtration assembly to form a filtered fluid. In block S630, the photoconductive member is maintained by periodically applying the filtered fluid to the photoconductive member and removing at least the filtered fluid therefrom. In an example, maintaining the photoconductive member may include cooling the filtered fluid to be applied to the photoconductive member. Maintenance of the photoconductive member may also include cleaning and cooling the photoconductive member through the periodic application of the filtered fluid thereto and removal of the filtered fluid therefrom. In an example, the method may also include detecting at least one fluid parameter, and automatically adding a predetermined amount of filtration material to the filtration assembly based on the detection of the at least one fluid parameter.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A liquid electrophotography printing apparatus (LEP), comprising:

a photoconductive member having a surface to form a latent image thereon;

a fluid chamber to store fluid having at least fluid particles, dissolved materials and a carrier liquid;

a filtration assembly in fluid communication with the fluid chamber, the filtration assembly to store filtration material to remove at least a portion of the fluid particles and the dissolved materials from the fluid from the fluid chamber to form a filtered fluid;

a detector assembly to detect at least one fluid parameter of the fluid;

a filtration adder unit to automatically add a predetermined amount of the filtration material to the filtration assembly based on the detection of the at least one fluid parameter; and a maintenance unit to periodically apply the filtered fluid from the filtration assembly to the photoconductive member and to remove at least the filtered fluid from the photoconductive member.

2. The LEP according to claim 1, wherein the filtration material comprises at least one of silica gel and activated carbon to remove at least a portion of the fluid particles and the dissolved materials by adsorption.

3. The LEP according to claim 1, wherein the maintenance unit comprises:

a cooling unit to receive and cool the filtered fluid from the filtration assembly to be applied to the photoconductive member;

an applicator unit to periodically apply the filtered fluid to the photoconductive member; and a removal unit to subsequently remove at least the filtered fluid from the photoconductive member.

4. The LEP according to claim 3, wherein to maintain the photoconductive member, the maintenance unit is to clean and cool the photoconductive member through the periodic application of the filtered fluid thereto and remove at least the filtered fluid therefrom.

5. The LEP according to claim 3, wherein fluid residue adheres to the photoconductive member after a fluid image corresponding to the latent image is transferred therefrom.

6. The LEP according to claim 5, wherein the fluid chamber comprises:

a waste compartment to store the fluid and the fluid residue removed from the photoconductive member; and a main compartment to store the filtered fluid.

7. The LEP according to claim 6, wherein at least one of the fluid particles and the dissolved materials comprise ink particles, charge directors, contaminants and the fluid residue.

8. The LEP according to claim 6, wherein the filtration assembly comprises:

a first filtration unit in fluid communication with the main compartment of the fluid chamber, the first filtration unit including the silica gel to filter the fluid from the main compartment to form a first-filtered fluid and to provide the first-filtered fluid to the main compartment; and a second filtration unit in fluid communication with the waste compartment and the main compartment of the fluid chamber, the second filtration unit including a mesh screen to filter the fluid from the waste compartment to form a second-filtered fluid and to provide the second-filtered fluid to the main compartment.

9. The LEP according to claim 1, wherein the at least one fluid parameter comprises a predetermined low field conductivity value.

10. The LEP according to claim 1, wherein the photoconductive member comprises a photo imaging member and the fluid comprises a liquid toner.

11. A method of maintaining a photoconductive member of a liquid electrophotography printing apparatus (LEP), the method comprising:

storing a fluid having at least fluid particles, dissolved materials and a carrier liquid in a fluid chamber;

removing at least a portion of the fluid particles and the dissolved materials from the fluid through adsorption by filtration material disposed within a filtration assembly to form a filtered fluid;

detecting at least one fluid parameter of the fluid;

automatically adding a predetermined amount of the filtration material to the filtration assembly based on the detection of the at least one fluid parameter; and maintaining the photoconductive member by periodically applying the filtered fluid to the photoconductive member and removing the filtered fluid and fluid residue therefrom.

12. The method according to claim 11, wherein the maintaining the photoconductive member further comprises:

cooling the filtered fluid to be applied to the photoconductive member; and cleaning and cooling the photoconductive member through the periodic application of the filtered fluid thereto and removing the filtered fluid therefrom.

13. A liquid electrophotography printing apparatus (LEP), comprising:

a photoconductive member having a surface to form a latent image thereon;

a fluid chamber to store fluid having at least fluid particles, dissolved materials and a carrier liquid;

a filtration assembly in fluid communication with the fluid chamber, the filtration assembly to automatically receive and store filtration material to remove at least a portion of the fluid particles and the dissolved materials by adsorption from the fluid of the fluid chamber to form a filtered fluid;

a detector assembly to detect at least one fluid parameter of the fluid;

a filtration adder unit to automatically add a predetermined amount of the filtration material to the filtration assembly based on the detection of the at least one parameter; and a maintenance unit to periodically apply the filtered fluid from the filtration assembly to the photoconductive member and to remove the filtered fluid from the photoconductive member.

* * * * *